US007740573B2

(12) United States Patent
Manley

(10) Patent No.: US 7,740,573 B2
(45) Date of Patent: Jun. 22, 2010

(54) DUNNAGE CONVERSION MACHINE WITH FLOATING GUIDES

(75) Inventor: Thomas E. Manley, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 184 days.

(21) Appl. No.: 11/630,734

(22) PCT Filed: Jun. 24, 2005

(86) PCT No.: PCT/US2005/022441

§ 371 (c)(1),
(2), (4) Date: Aug. 13, 2007

(87) PCT Pub. No.: WO2006/012283

PCT Pub. Date: Feb. 2, 2006

(65) Prior Publication Data

US 2008/0125301 A1 May 29, 2008

Related U.S. Application Data

(60) Provisional application No. 60/582,785, filed on Jun. 25, 2004.

(51) Int. Cl.
*B31B 1/00* (2006.01)

(52) U.S. Cl. ..... 493/464; 493/407; 493/352; 493/904

(58) Field of Classification Search ..... 493/464, 493/459, 904, 967, 407, 352, 350
See application file for complete search history.

(56) References Cited

U.S. PATENT DOCUMENTS

| | | | | | |
|---|---|---|---|---|---|
| 2,786,399 | A | * | 3/1957 | Mason et al. | 493/369 |
| 2,882,802 | A | * | 4/1959 | Walker | 493/45 |
| 2,924,154 | A | * | 2/1960 | Russell et al. | 493/464 |
| 3,509,798 | A | * | 5/1970 | Johnson | 493/407 |
| 3,603,216 | A | * | 9/1971 | Johnson | 493/359 |
| 4,717,613 | A | * | 1/1988 | Ottaviano | 428/129 |
| 4,750,896 | A | * | 6/1988 | Komaransky et al. | 493/357 |
| 4,968,291 | A | | 11/1990 | Baldacci et al. | |
| 5,061,543 | A | * | 10/1991 | Baldacci | 428/126 |
| 6,106,452 | A | | 8/2000 | Baumuller et al. | |
| 6,387,029 | B1 | * | 5/2002 | Lencoski | 493/464 |
| 6,699,167 | B2 | * | 3/2004 | Manley | 493/464 |
| 2003/0139272 | A1 | | 7/2003 | Simmons | |

* cited by examiner

*Primary Examiner*—Sameh H. Tawfik
(74) *Attorney, Agent, or Firm*—Renner, Otto, Boisselle & Sklar, LLP

(57) ABSTRACT

A dunnage conversion machine (115), wherein sheet stock material is crumpled to form a crumpled strip, includes a feeding assembly (132). The feeding assembly (132) includes opposed feeding members that engage and advance the crumpled strip therebetween. One of the feeding members (141) includes a rotating member (141) supported on a shaft (144) for rotation about the axis of the shaft, the shaft being mounted for transverse movement toward and away from the other feeding member (140) to accommodate variations of the thickness of the crumpled strip as it is advanced between the opposed feeding members (140 and 141). The conversion machine (115) also includes a guide member (200) positioned laterally adjacent to the rotating member (141) progressively to guide a portion of the crumpled strip underneath the shaft (144). The guide member (200) has at least a portion adjacent the shaft (144) that is transversely movable.

10 Claims, 4 Drawing Sheets

DUNNAGE CONVERSION MACHINE WITH FLOATING GUIDES

For purposes of the United States, this application claims the benefit of U.S. Provisional Patent Application No. 60/582,785, filed Jun. 25, 2004, which is hereby incorporated herein by reference.

FIELD OF THE INVENTION

The present invention relates to a dunnage conversion machine and method, and more particularly to a dunnage conversion machine having an improved feeding mechanism that resists jamming.

BACKGROUND

Various dunnage conversion machines crumple a sheet stock material into a strip of dunnage useful as a packaging material. Exemplary dunnage conversion machines are disclosed in U.S. Pat. Nos. 6,540,652 and 6,387,029, both of which are incorporated herein by reference.

Dunnage conversion machines typically include a feeding assembly that includes opposed members for engaging and advancing a crumpled strip of the stock material. Usually, one of the opposed members is a rotating member mounted on a shaft that can move transversely towards and away from the other opposed member to accommodate variations in thickness of the crumpled strip. These thickness variations can be substantial, especially when using different stock materials. The stock material can be composed of one or more plies of paper, the number of plies can be varied, and the one or more plies of the stock material can include plies with different bias weights to impart different dunnage characteristics to the strip of dunnage produced by the conversion machine. Consequently, the thickness and characteristics of the dunnage strip passing through the feeding assembly can vary significantly, which can present problems or adverse performance in known dunnage conversion machines.

SUMMARY

The present invention provides a dunnage conversion machine that minimizes or eliminates jamming or other performance problems. In accordance with the invention, a floating guide is provided to assist in guiding the crumpled strip through the feeding assembly. The guide can move transversely to accommodate a wide variation in the thickness of the crumpled strip passing through the feeding assembly.

A dunnage conversion machine provided in accordance with the present invention, wherein sheet stock material is crumpled to form a crumpled strip, comprises a feeding assembly that includes opposed feeding members that engage and advance the crumpled strip therebetween. One of the feeding members includes a rotating member supported on a shaft for rotation about the axis of the shaft, the shaft being mounted for transverse movement toward and away from the other feeding member to accommodate variations of thickness of the crumpled strip as it is advanced between the opposed feeding members. The conversion machine also includes a guide member positioned laterally adjacent the rotating member progressively to guide a portion of the crumpled strip underneath the shaft. The guide member has at least a portion thereof adjacent the shaft that is transversely movable.

The guide member can include a surface that extends progressively further from the shaft. A pair of laterally spaced apart side walls define a channel that laterally constrains the stock material adjacent the rotating member, and the guide surface extends substantially the entire distance between the rotating member and at least one side wall. The guide member generally extends beyond the radial extent of the rotating member. The machine can include another guide member, and the two guide members can be mounted on axially opposite sides of the rotating member.

The feeding assembly typically moves the stock material through a forming assembly that forms the sheet stock material into a relatively less dense strip of dunnage. The pair of opposed rotating members can be biased toward one another, and the shafts of the rotating members can be parallel to each other.

These and other features of the invention are fully described and particularly pointed out in the claims. The following description and annexed drawings set forth in detail one illustrative embodiment of the invention, this embodiment being indicative of but one of the various ways in which the principles of the invention may be employed.

DETAILED DESCRIPTION

Figure 1:
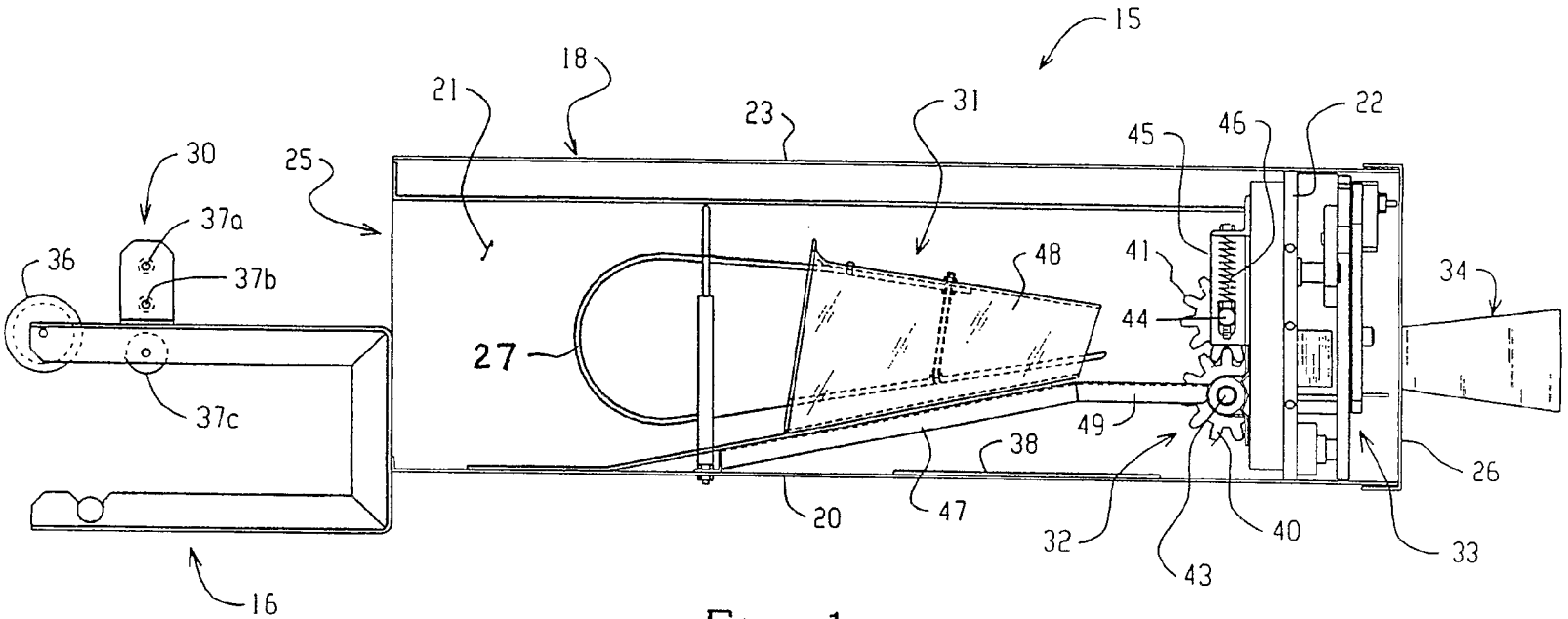
Fig. 1 PRIOR ART
FIG. 1 is a side view of the dunnage conversion machine disclosed in U.S. Pat. No. 6,387,029, with a side panel of the machine's housing nearest the viewer removed to permit viewing internal machine components, including a feeding assembly.

Referring now to the drawings in detail, and initially to FIG. 1, an exemplary dunnage machine 15 includes a conversion assembly for converting a sheet stock material into a relatively less dense dunnage product. The conversion assembly typically includes a forming assembly 31 that forms the sheet stock material into a strip of dunnage and a feeding assembly 32 that advances the stock material through the forming assembly 31. In the illustrated embodiment, the feed assembly 31 also connects overlapped portions of the stock material to keep the strip of dunnage from coming apart as it is manipulated.

The dunnage conversion machine, or converter 15, has at its upstream end 25 (to the left in FIG. 1) a holder 16 for a supply, such as a roll, of sheet stock material. The stock material generally consists of one to three superimposed plies or layers of biodegradable, recyclable and reusable kraft paper rolled onto a hollow cylindrical tube. Other types of sheet stock material can be acceptable alternatives, including for example, other types of paper, fan-folded stock material, discrete sheets, plastic sheet material, etc. The illustrated converter 15 converts the stock material into a crumpled strip having lateral pillow portions separated by a narrow central band. The overlapping layers of sheet material in the central band are connected to form a coined strip of dunnage that can be severed, as by cutting, into sections, or pads, of a desired length.

The machine 15 includes a housing 18 having a base plate or wall 20, side plates or walls 21, an end plate or wall 22 and a top wall 23 which collectively form an enclosed frame structure. The housing (or frame) 18 also includes a front cover or plate 26. The end plate 22 and front plate 26 bound upstream and downstream ends of a box-like extended portion of the downstream end of the housing 18.

The machine 15 further includes a stock supply assembly 30, a forming assembly 31, a feeding assembly 32, a severing assembly 33, and a post-cutting guide assembly 34. The stock supply assembly 30, including a constant entry roller 36 and separators 37*a*-37*c*, is mounted adjacent an upstream side of the housing 18. The forming assembly 31 is located downstream of the stock supply assembly 30 interiorly of the housing and functions to form the stock material into a continuous three-dimensional strip of dunnage with portions of the stock material overlapped along the central region of the strip. The terms "up-stream" and "downstream" are herein used in relation to the direction of flow of the stock material through the machine 15.

The forming assembly 31 includes a shaping member 27 and a converging chute 48 that cooperate to form and crumple the stock material as it advances through the forming assembly 31. The stock material travels between the shaping member 27 and the chute 48, which also causes lateral edges of the stock material to turn inwardly. The dunnage machine 15 can further include a pad width adjustment device 90 (FIG. 2) upstream of the feeding assembly 32 to limit the width of the strip entering the feeding assembly. Also, the forming assembly is provided with a guide ramp 47 to which the chute 48 is mounted, the guide ramp having an extended guide surface portion 49 extending from the downstream end of the shaping chute into close proximity to the feeding assembly 32.

The feeding assembly 32 in the illustrated machine performs two functions. The feeding assembly 32 connects the overlapped portions of the stock material to maintain the three-dimensional shape of the strip of dunnage. The feeding assembly 32 also advances the stock material through the machine, as by pulling the stock material from the stock supply assembly 30 and through the forming assembly 31. In the illustrated embodiment these dual functions are carried out by a pair of opposed feeding members, including rotating members 40 and 41. One of the members 40 is mounted on a shaft 43 rotatably driven by the feed motor whereas the other member 41 is mounted on an idler carried on a floating idler shaft 44. The driven member 40 rotates about an axis fixed with respect to the front plate 22 whereas the idler member 41 is carried on the floating shaft which is guided by guide slots in guides 45 for parallel translating movement in a transverse direction toward and away from the driven shaft 43. The floating shaft 44, and thus the floating idler member 41, is resiliently biased by a spring 46 or other suitable resilient biasing means toward the driven member 40.

In operation of the machine 15, the stock supply assembly 30 supplies stock material to the forming assembly 31. The forming assembly 31 causes inward rolling, shaping and crumpling of the sheet stock material to form lateral pillow portions of a continuous strip of dunnage. The feeding assembly 32 advances the stock material through the forming assembly 31 and also connects the central band to form a connected dunnage strip. As the connected dunnage strip travels downstream from the feeding assembly 32, the severing assembly 33 severs or cuts the dunnage strip into sections, or pads, of a desired length. The severed pads then travel through the post-severing assembly 34.

The machine 15 as thus far described is generally the same as the machine described in greater detail in U.S. Pat. No. 6,387,029, and reference may be had thereto for further details of the general arrangement and operation of the machine.

As the sheet stock material is drawn through the dunnage conversion machine 15, the stock material is manipulated by the forming assembly 31 to give the stock material structure and shape as a relatively less dense strip of dunnage. As the stock material advances through the forming assembly 31, the stock material crumples, forming chevrons, crevices, folds, and other similar vertical and angular surfaces. The size and shape of these folds, crevices, etc. generally is dependent on multiple factors, such as the type of stock material, the type of forming assembly and the speed at which the stock material is advanced through the forming assembly. The crumpled surfaces have to pass under the idler shaft 44 of the rotating member 41 in the feeding assembly 23. As these surfaces hit the shaft 44, some surfaces can extend above the shaft 44 and are pulled against the shaft as the stock material advances between the rotating members 40 and 41. When the surfaces are stiff enough, the stock material can wrap around the shaft 44 and hold back or slow down the feeding of the stock material. This forces the stock material that is in engagement with the rotating member 41 to travel upward and potentially jam the rotating members 40 and 41 and prevent or inhibit further rotation, or otherwise hinder the smooth advancement of the stock material through the forming assembly 31.

The dunnage converter provided by the present invention includes further improvements to the feeding assembly that serves to minimize or prevent jamming or other problems. Except as otherwise provided, the dunnage converter provided by the present invention is the same as the prior art dunnage converter described above.

Figure 2:
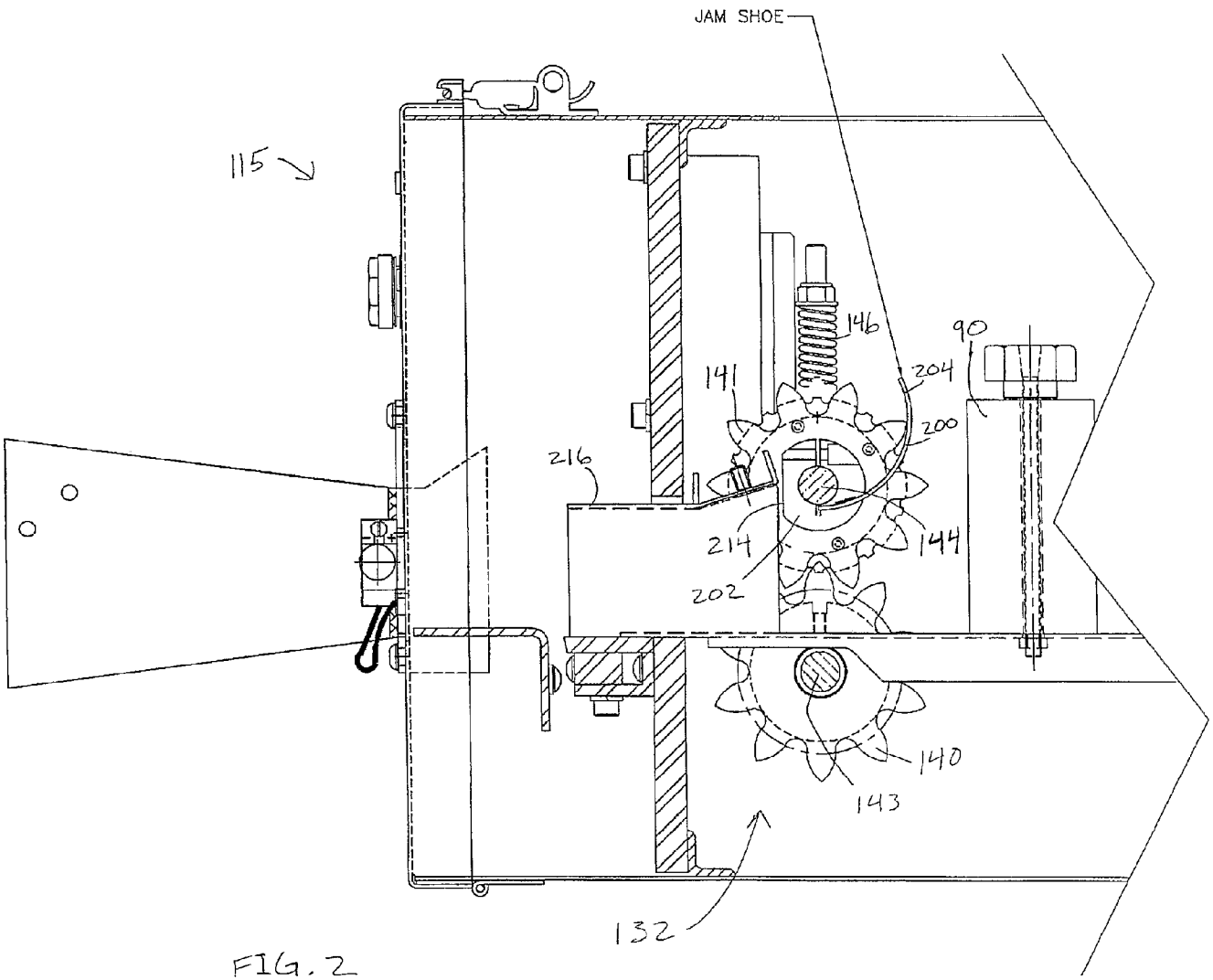
FIG. 2 is an enlarged cross-sectional side view of a portion of a dunnage conversion machine in the vicinity of a feeding assembly provided by the present invention.
Figure 3:
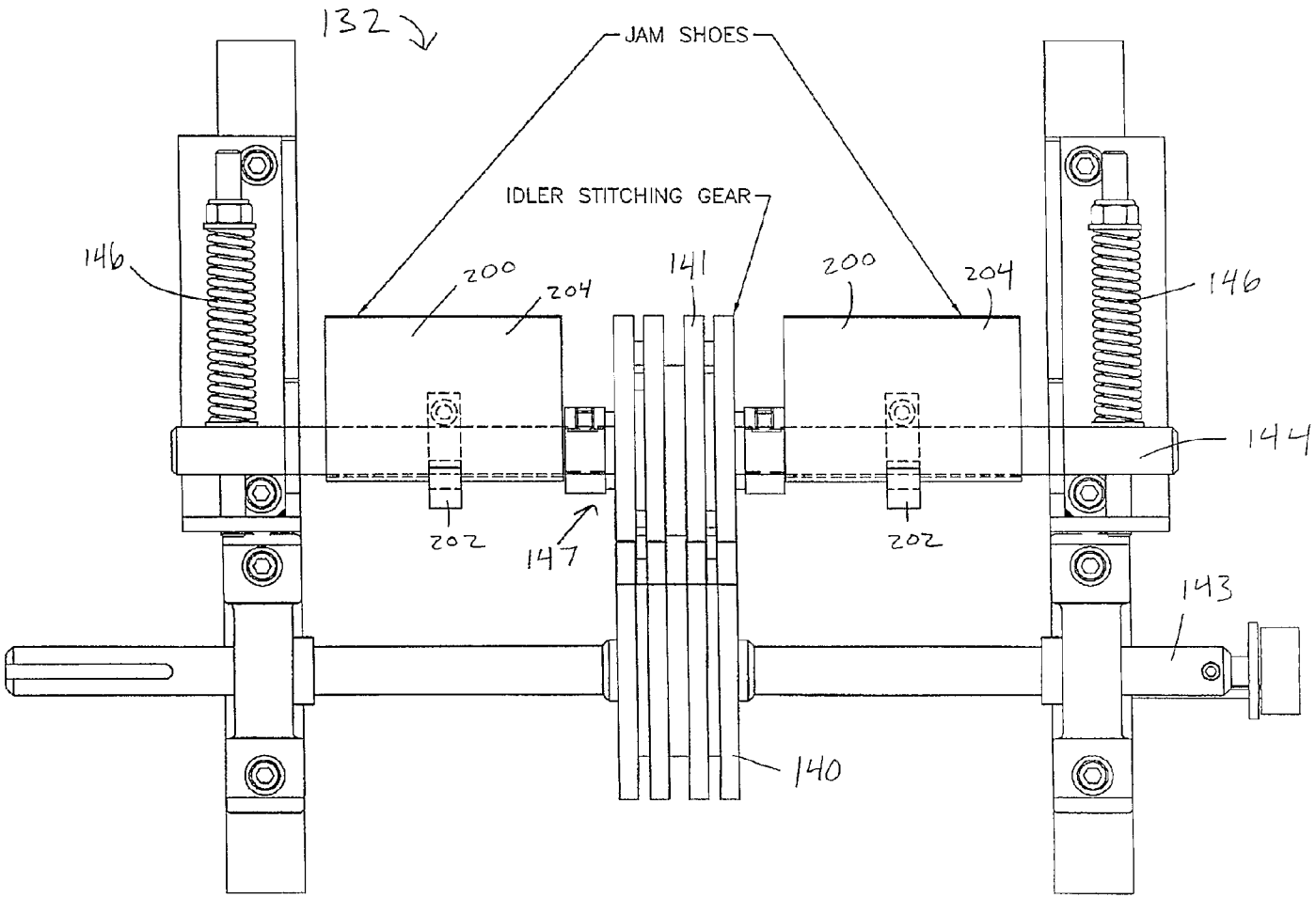
FIG. 3 is a front view of the feeding assembly shown in FIG. 2
Figure 4C:
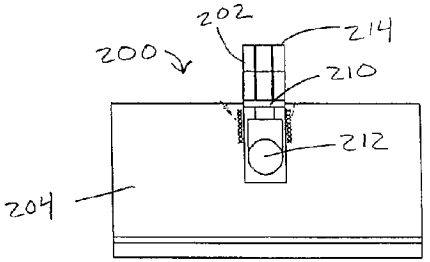
FIG. 4A-4D are side and front views of a guide shoe for the feeding assembly provided by the present invention.
Figure 4D:
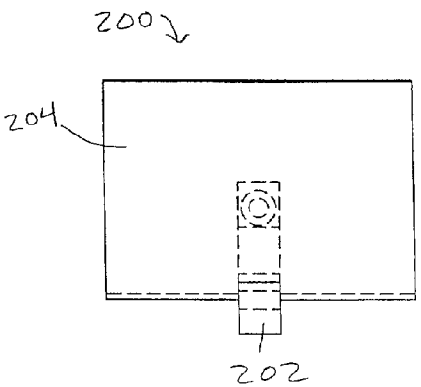
Figure 4A:
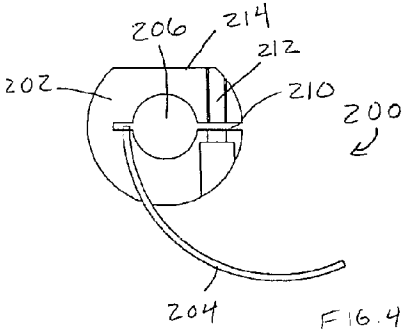
Figure 4B:
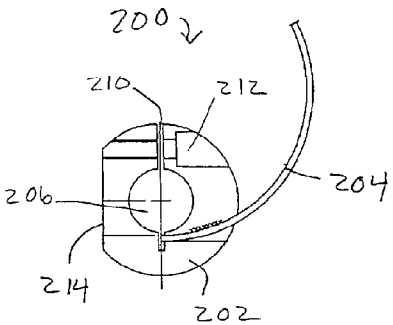

As shown in FIGS. 2 and 3, the dunnage converter 115 provided by the present invention includes a feeding assembly 132 with a pair of opposed rotating members 140 and 141 mounted on respective opposed driven and idler shafts 143 and 144. The idler rotating member 141 is mounted to the idler shaft 144 with a bushing 147 that allows the rotating member 141 to rotate relative to the shaft 144. In the illustrated feeding assembly 132, the driven and idler shafts, 143 and 144 are parallel to each other. The idler rotating member 141 is biased into engagement with the driven rotating member 140 by a pair of springs 146 acting on ends of the idler shaft 144. The illustrated rotating members 140 and 141 are gears. The springs 146 keep the rotating members 140 and 141 engaged with each other while allowing the crumpled stock material to pass therebetween.

The feeding assembly 132 further includes a pair of guide members 200, sometimes called "shoes", mounted to the idler shaft 144 adjacent the idler rotating member 141. The guide members 200 provided by the present invention eliminate or minimize the problems associated with the crumpled stock material catching on the idler shaft 144. The guide members 200 present a surface to the stock material that is larger than the idler shaft 144 and present a surface that is inclined relative to the upstream-downstream direction to gradually engage the pillow portions of the crumpled strip and guide them under the idler shaft 144. The guide member 200 can be angled or curved, but generally extends progressively away from the shaft 144.

As shown in FIGS. 2, 3, and 4A-4D, the guide members 200 employ an inclined portion that presents a larger surface than the shaft 144, and provides a lead in to the feeding assembly 132 that is more gradual and not as abrupt as the shaft 144 alone. The illustrated guide members 200 include a curved surface that has a radius that is larger than the radius of the shaft 144, in the nature of a larger radius portion of a tube. This larger surface will span some of the crevices, folds, etc., created in the crumpled strip better than the idler shaft 144 and inhibits or prevents the crumpled strip from jamming or otherwise interfering with the feeding operation.

The illustrated guide members 200 include a clamp collar 202 and a shield that generally forms the guide surface 204. The clamp collar 202 is essentially a nut with a circular central opening 206 approximately the size of the idler shaft 144, a radial slot 210, and a passage 212 that traverses the slot. A screw or bolt can be inserted into the passage 212 and across the slot 210 to pull the portions of the nut across the slot together thereby reducing the size of the central opening 206 and allowing the collar 202 to grip the shaft 144. The collar 202 mounts to the idler shaft 144, and a hex screw can be employed in the passage 212 so that a hex key can be used to tighten the collar onto the shaft. Alternatively, the guide member can be mounted to the frame and extend between the shafts of the rotating members. In such a case, at least a portion of the guide member adjacent the shaft 144 is resilient and thus can move toward the shaft 144 as the strip passes by.

The clamp collar 202 also has a flattened surface 214 that generally is parallel to the axis of the central opening 206. This makes the guide member 200 easier to retrofit on existing converters because it allows the collar 202 to fit within the space between the idler shaft 144 and the tunnel 216 downstream of the rotating members 140 and 141. The tunnel 216 defines a maximum width of the strip of dunnage and defines a passage from the feeding assembly 132. The tunnel 216 includes a pair of laterally-spaced-apart side walls that define a channel and laterally constrain the stock material in an area adjacent the feed assembly 132. The shield 204 extends substantially the entire distance along the idler shaft 144 adjacent the rotating member 141, and preferably at least as far as the distance between the rotating member 141 and a side wall.

The shield 204 is welded or otherwise attached to the clamp collar 202 to provide an inclined surface against which the crumpled surfaces of the dunnage strip can ride as they pass under the shaft 144. The clamp collar 202 typically is affixed to a central part of the shield 204 in a dimension parallel to the shaft, and a curved portion of the collar 202 extends below the shield 204, but this typically does not interfere with the passage of the crumpled strip. The guide members 200 are mounted so that the shield 204 extends upstream from the idler shaft 144. The shield 204 generally extends at least as far as, if not beyond, the radial extent of the idler rotating member 141 to ensure that the crumpled strip will be unlikely to catch on the distal end of the shield, although a shorter shield can be satisfactory for many applications. Additionally, the shields generally span most of the length of the shaft 144 that otherwise would be exposed to the crumpled strip.

Additionally, although the illustrated shield 204 has a radius greater than the radius of the shaft 144, the shield is not necessarily a circular arc segment or even curved. The shield 204 provides an inclined surface that extends progressively further from the shaft 144 and guides the upper surfaces of the crumpled strip under the idler shaft 144, but that inclined surface is not limited to the illustrated curved surface. The means for mounting the guide member 200 also is not limited to the illustrated collar 202, although the collar provides an excellent way to direct the strip under the idler shaft 141 as the idler shaft moves vertically when the central portion of the strip moves between the rotating members 140 and 141. The shield 204 also can have a resilient quality, in the nature of a spring, to move as the crumpled stock material impinges on it.

The guide members 200 described herein can be added to any dunnage conversion machine that has at least one rotating member and an exposed shaft adjacent the one or more rotating members.

Although the invention has been shown and described with respect to a certain embodiment, equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment of the invention.

What is claimed:

1. A dunnage conversion machine wherein sheet stock material is crumpled to form a crumpled strip, comprising a feeding assembly that includes opposed feeding members that engage and advance the crumpled strip therebetween, one of the feeding members including a rotating member supported on a shaft for rotation about the axis of the shaft, the shaft being mounted for movement in a transverse direction, transverse the axis of the shaft, toward and away from the other feeding member to accommodate variations of thickness of the crumpled strip as it is advanced between the opposed feeding members, and a guide member positioned laterally adjacent the rotating member progressively to guide a portion of the crumpled strip underneath the shaft, wherein the guide member is mounted to the shaft for movement with the shaft, and has a surface that extends progressively further from the shaft in an upstream direction and that extends progressively transversely further away from the opposed feeding member in the transverse direction.

2. A dunnage conversion machine as set forth claim 1, wherein the guide member includes a curved surface that has a radius that is larger than the radius of the shaft.

3. A dunnage conversion machine as set forth in claim 1, wherein the feeding assembly moves the stock material through a forming assembly that forms the sheet stock material into a relatively less dense strip of dunnage.

4. A dunnage conversion machine as set forth in claim 1, wherein the opposed feed members each includes a rotating member supported on a shaft, and the rotating members are biased toward one another.

5. A dunnage conversion machine as set forth in claim 4, wherein the shafts of the rotating members are parallel to each other.

6. A dunnage conversion machine as set forth in claim 1, wherein a pair of laterally spaced apart side walls define a channel that laterally constrains the stock material adjacent the rotating member.

7. A dunnage conversion machine as set forth in claim 6, wherein the guide surface extends substantially the entire distance between the rotating member and at least one side wall.

8. A dunnage conversion machine as set forth in claim 1, wherein the rotating member has a circular cross-section and the guide member extends at least as far as the radial extent of the rotating member.

9. A dunnage conversion machine as set forth in claim 1, including another guide member, the two guide members being mounted on axially opposite sides of the rotating member.

10. A dunnage conversion machine as set forth in claim 1, wherein the guide member has a portion that is movable relative to the shaft.

* * * * *